US009319774B2

(12) United States Patent
Kalkman

(10) Patent No.: US 9,319,774 B2
(45) Date of Patent: Apr. 19, 2016

(54) LOUDSPEAKER UNIT WITH TWO LOUDSPEAKERS AND A WEDGE-SHAPED BODY BETWEEN THE SPACES ADJOINING THE LOUDSPEAKERS

(75) Inventor: Hubert Kalkman, Breda (NL)

(73) Assignee: Kalkmann Sound Systems B.V., Kaatsheuvel (NL)

( * ) Notice: Subject to any disclaimer, the term of this patent is extended or adjusted under 35 U.S.C. 154(b) by 0 days.

(21) Appl. No.: 14/342,274

(22) PCT Filed: Sep. 3, 2012

(86) PCT No.: PCT/NL2012/050607
§ 371 (c)(1),
(2), (4) Date: Jun. 6, 2014

(87) PCT Pub. No.: WO2013/032338
PCT Pub. Date: Mar. 7, 2013

(65) Prior Publication Data

US 2014/0294220 A1 Oct. 2, 2014

(30) Foreign Application Priority Data

Sep. 2, 2011 (NL) ..... 2007341

(51) Int. Cl.
*H04R 1/28* (2006.01)
*H04R 1/24* (2006.01)
*H04R 3/14* (2006.01)

(52) U.S. Cl.
CPC ..... *H04R 1/2888* (2013.01); *H04R 1/24* (2013.01); *H04R 1/2803* (2013.01); *H04R 1/288* (2013.01); *H04R 1/2811* (2013.01); *H04R 3/14* (2013.01); *H04R 2201/029* (2013.01)

(58) Field of Classification Search
CPC ..... H04R 1/2888; H04R 1/2803; H04R 1/24; H04R 1/288; H04R 3/14; H04R 1/2811; H04R 2201/029
See application file for complete search history.

(56) References Cited

U.S. PATENT DOCUMENTS

| | | | | |
|---|---|---|---|---|
| 5,602,367 | A | 2/1997 | Meyer | |
| 2007/0280499 | A1 * | 12/2007 | Foletta | 381/413 |
| 2011/0007923 | A1 * | 1/2011 | Kalkman et al. | 381/353 |

FOREIGN PATENT DOCUMENTS

EP 1851991 B1 7/2009

OTHER PUBLICATIONS

International Search Report and Written Opinion mailed Jan. 2, 2013 (PCT/NL2012/050607); ISA/EP.

* cited by examiner

*Primary Examiner* — Tuan D Nguyen
(74) *Attorney, Agent, or Firm* — Banner & Witcoff, Ltd.

(57) ABSTRACT

A loudspeaker unit comprising a loudspeaker housing and a first and a second loudspeaker, wherein the two loudspeakers are both placed in a flat front wall of the loudspeaker housing, the rear side of the first loudspeaker adjoins a first space in the loudspeaker box and the rear side of the second loudspeaker adjoins a second space in the loudspeaker box, and the first and the second space in the loudspeaker box are separated by a wedge-shaped body, the base of which is connected to a wall placed opposite the front wall and the intersection between the sloping surfaces of which is located in the vicinity of the front wall, wherein the wedge has a length in the direction transversely of the plane of the front wall that is at least twice the distance between the sloping surfaces at the position of the base of the wedge-shaped body.

18 Claims, 1 Drawing Sheet

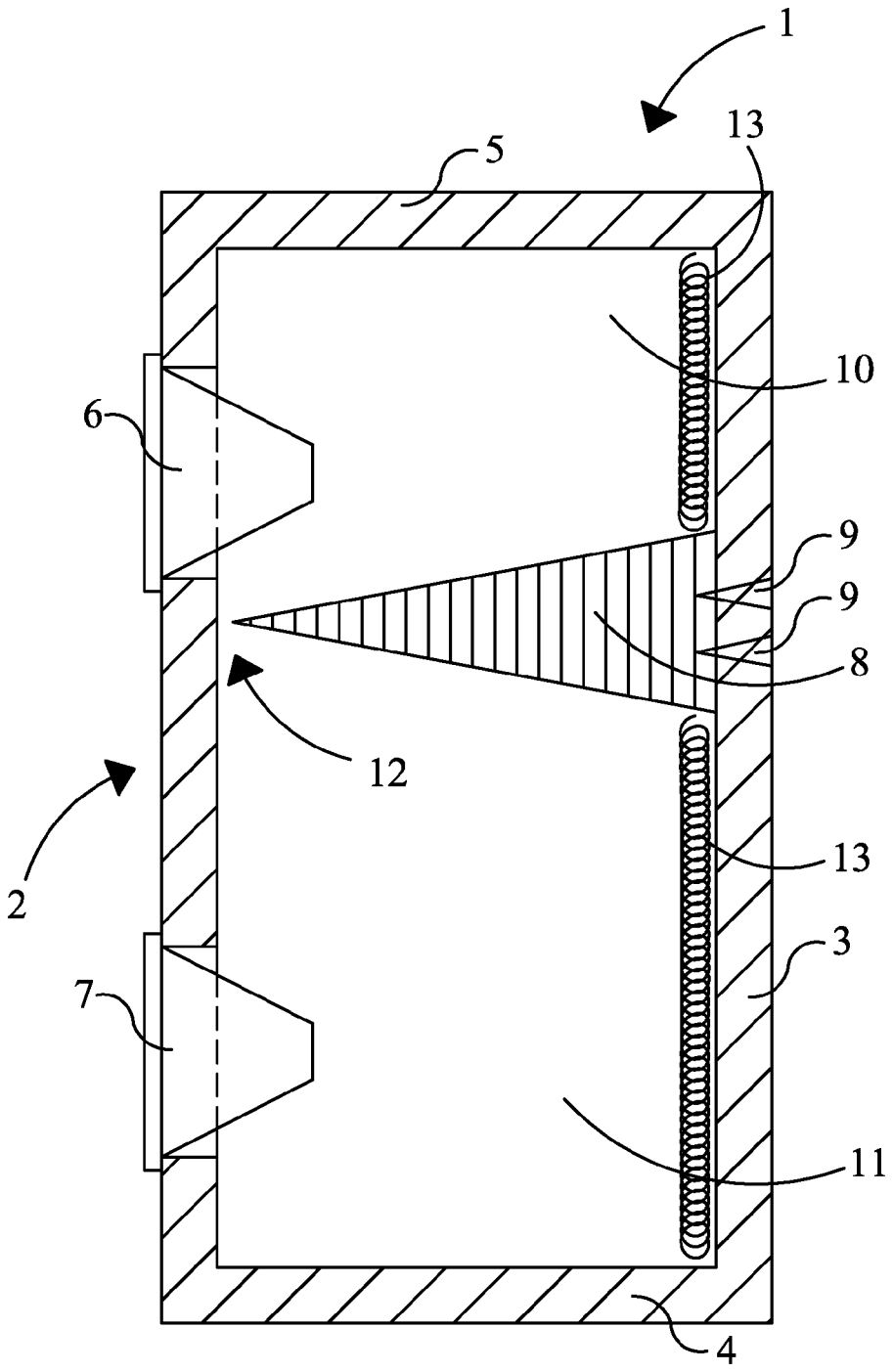
1
13
5
10
6
9
9
8
12
2
13
3
7
11
4

LOUDSPEAKER UNIT WITH TWO LOUDSPEAKERS AND A WEDGE-SHAPED BODY BETWEEN THE SPACES ADJOINING THE LOUDSPEAKERS

The present application is a U.S. National Phase filing of International Application No. PCT/NL2012/050607, filed on Sep. 3, 2012, designating the United States of America and claiming priority to and the benefit of NL 2007341, filed Sep. 2, 2011. The present application claims priority to and the benefit of the above-identified applications, and the above-identified applications are incorporated by reference herein in their entirety.

The invention relates to a loudspeaker unit comprising a loudspeaker housing and at least a first and a second loudspeaker, wherein the first and the second loudspeakers are both placed in a flat front wall of the loudspeaker housing, wherein the rear side of the first loudspeaker adjoins a first space in the loudspeaker box and the rear side of the second loudspeaker adjoins a second space in the loudspeaker box, and the first and the second space in the loudspeaker box are separated by a wedge-shaped body, the base of which is connected to a wall placed opposite the front wall and the intersection between the sloping surfaces of which is located in the vicinity of the front wall.

Such a loudspeaker unit is known from EP-1 851 991.

This document describes such a loudspeaker unit with a wedge-shaped body, wherein the angles between the sloping sides and the front wall lie between 50° and 80°. This implies a relatively obtuse angle. The sound quality achieved herewith is satisfactory.

The object of the invention is to provide a loudspeaker unit of the stated type with an improved sound quality.

This object is achieved with such a loudspeaker unit, wherein the wedge has a length in the direction transversely of the plane of the front wall that is at least twice the distance between the sloping surfaces at the position of the base of the wedge-shaped body.

It has now been found that with a more acute angle the results, i.e. the matching of the acoustic impedance of the loudspeakers, and thereby the improvement in the quality of the loudspeaker unit, are considerable. This is caused particularly by the phase coincidence of the sound generated by the two loudspeakers in which the wedge, as separating medium between the two spaces in which the loudspeakers are placed, plays a part.

The acuteness of the angle is therefore preferably expressed in that the wedge has a length in the direction transversely of the plane of the front wall which is at least twice the distance between the sloping surfaces at the position of the base of the wedge-shaped body.

It is in principle possible for the cross-section of the wedge-shaped body transversely of the sloping surfaces to be formed by an isosceles triangle. A certain degree of symmetry is hereby obtained for the transfer of vibrations between the two spaces.

In order to take into account the usually differing frequency range of the loudspeakers, the cavities adjoining the rear side of the loudspeakers can otherwise have a differing shape.

It is however also possible for the cross-section of the wedge-shaped body transversely of the sloping surfaces to be formed by a scalene triangle. Such an embodiment makes direct allowance for the usually differing frequency characteristics of the loudspeakers. Although the asymmetry of the wedge-shaped body takes into account the different frequency characteristics when similar loudspeaker spaces are applied, it is also possible that the loudspeaker spaces are different.

The inventor has found that particularly attractive results are obtained when the apex angle of the wedge-shaped body is less than 10°. This is the case for both the above elucidated isosceles cross-section and the scalene cross-section of the wedge-shaped body.

Although it is possible in principle to manufacture the wedge-shaped body from an isotropic material such as plastic or medium density fibreboard, it is recommended that the wedge-shaped element be manufactured from a non-isotropic material such as wood, and that the grain of the wood extends with a component parallel to the front wall of the loudspeaker box. This configuration then comprises two directions, i.e. parallel to the connecting line between the centre of the two speakers and transversely thereof, while oblique directions are not precluded. Nor is it precluded to assemble the wedge-shaped body from different parts, although it is recommended to manufacture the wedge-shaped body from a single piece. In the case of assembly from different parts, it is recommended to have the separating line or lines between the two or more parts extend in the direction parallel to the connecting line between the two loudspeakers.

Although other methods of fixing, such as adhesive, are not precluded, it is recommended that the wedge-shaped body is connected by means of a screw connection to the wall of the loudspeaker box placed opposite the front wall.

There is preferably a gap present between the front wall and the wedge. This narrow gap serves for acoustic coupling of the two spaces. This gap preferably has a width between 0.3 mm and 3 mm, preferably of 1 mm.

Apart from the gap between the loudspeaker wall and the wedge-shaped body, it is recommended that the loudspeaker box be provided with flat side walls and that a gap is present between each of the side walls and the wedge. This enhances an effective coupling between the two spaces. It is also recommended here that the gap has a width between 0.3 mm and 3 mm, preferably of 1 mm.

The application of the wedge-shaped body provides for acoustic coupling and damping between the two spaces, since the wedge-shaped body is set into vibration. This is facilitated by the fact that the body is not connected to the front wall, nor is it connected to the side walls. It is not however possible to preclude the wedge-shaped body connecting directly to the walls. This is because movement is then also possible in the directions parallel to the walls.

The quality of the sound reproduction is also found to improve when at least the wall placed opposite the loudspeaker wall is provided with damping material such as wool. This layer is preferably relatively thin, in the order of magnitude of 3 cm or less.

It is further noted that the measures according to the invention make it possible to apply thinner walls in the loudspeaker box.

According to a further preferred embodiment, the length of the loudspeaker unit in the direction transversely of the main plane of the wedge is at least twice the width of the loudspeaker unit in the direction of the apex line of the wedge. The inventor has found during research that the advantages of the invention, particularly in respect of the phase coincidence of the sound generated by the loudspeakers, become more clearly manifest when the loudspeakers are accommodated in a long housing, for instance when the length of the loudspeaker unit is two, four, five or six times greater than the width thereof. It would seem at the moment that this effect is stronger when the loudspeakers are placed at the ends.

It is noted that the above applies to loudspeaker units which are provided with two loudspeakers. That these measures are likewise applied in loudspeaker units provided with more loudspeakers, for instance three or four loudspeakers, is not precluded. When there are three loudspeakers these can be placed in a row, wherein a wedge-shaped body preferably complying with the above elucidated measures is present between each of the two outer loudspeakers and the central loudspeaker. The same is also possible in the case of four or five loudspeakers in a row. It is also possible to combine the loudspeakers in groupwise manner in a single space, in particular though not exclusively when the loudspeakers have the same frequency characteristic. It is likewise possible to incorporate in the loudspeaker unit, in addition to the above discussed loudspeakers, a separate loudspeaker which is accommodated in a space not coupled to the other spaces. This is the case particularly, though not exclusively, for loudspeakers for high tones.

Application of the invention likewise makes it possible in many cases to apply the loudspeakers with differing frequency characteristics without a crossover filter, either an active crossover filter or a passive crossover filter.

FIG. 1 shows a cross-section of such a loudspeaker unit. This loudspeaker unit comprises a loudspeaker box 1 with a loudspeaker wall 2, a rear wall 3, a base 4 and an upper wall 5. The loudspeaker of course also comprises side walls which are not visible in this cross-section. The walls are preferably manufactured from wood-like material such as chipboard, multiplex or MDF. Arranged in loudspeaker wall 2 are two openings in which loudspeakers 6, 7 are placed. The upper loudspeaker 6 is adapted to reproduce high tones and the lower loudspeaker 7 is adapted to reproduce low tones.

Arranged between the spaces adjoining the relevant loudspeakers 6, 7 is a wedge-shaped body 8 which is attached at its base to rear wall 3 with a screw connection 9. Rear wall 3 extends here opposite loudspeaker wall 2 and parallel to loudspeaker wall 2. Wedge-shaped body 8 forms a separation between cavity 10 adjoining loudspeaker 6 and cavity 11 adjoining loudspeaker 7. A gap 12 is left clear between wedge-shaped body 8 and loudspeaker wall 2. A gap is left clear in the same way between each of the side walls and wedge-shaped body 8. The inner side of rear wall 3 is covered with a thin layer of damping material 13.

The loudspeaker is further provided with terminals (not shown in the drawing) connected by means of electrically conductive wires (not shown in the drawing) to the loudspeakers. If a crossover filter is not applied, the loudspeakers are connected in parallel. It is however also possible to apply a crossover filter, wherein the loudspeakers are connected to the output connections of the crossover filter.

The direction of the grain in the wood from which the wedge-shaped body is manufactured extends in vertical direction in the drawing, i.e. in the direction of the connecting line between the loudspeakers.

The invention claimed is:

1. Loudspeaker unit, comprising a loudspeaker housing and at least a first and a second loudspeaker, wherein the first and the second loudspeakers are both placed in a flat front wall of the loudspeaker housing, wherein the rear side of the first loudspeaker adjoins a first space in the loudspeaker housing and the rear side of the second loudspeaker adjoins a second space in the loudspeaker housing, and the first and the second space in the loudspeaker housing are separated by a wedge-shaped body having a base and sloping surfaces, wherein the base of the wedge-shaped body is connected to a wall placed opposite the front wall, and an intersection between the sloping surfaces of the wedge-shaped body is located in the vicinity of the front wall, wherein the wedge-shaped body has a length in a direction transverse of a plane of the front wall that is at least twice a distance between the sloping surfaces at a position of the base of the wedge-shaped body, wherein an apex angle of the wedge-shaped body is less than 10° and a cross-section of the wedge-shaped body transverse of the sloping surfaces forms a scalene triangle.

2. Loudspeaker unit as claimed in claim 1, wherein a cross-section of the wedge-shaped body is asymmetric.

3. Loudspeaker unit as claimed in claim 1, wherein the wedge-shaped body is manufactured from wood, and a grain of the wood extends parallel to the front wall of the loudspeaker housing.

4. Loudspeaker unit as claimed in claim 3, wherein the grain of the wood extends parallel to a connecting line between a centre of the two loudspeakers.

5. Loudspeaker unit as claimed in claim 3, wherein the grain of the wood extends parallel to a connecting line between a centre of the two loudspeakers.

6. Loudspeaker unit as claimed in claim 1, Wherein the wedge-shaped body is connected by a screw connection to the wall of the loudspeaker housing placed opposite the front wall.

7. Loudspeaker unit as claimed in claim 1, wherein the wedge-shaped body is connected by an adhesive connection to the wall of the loudspeaker housing placed opposite the front wall.

8. Loudspeaker unit as claimed in claim 1, wherein a gap is present between the front wall and the wedge-shaped body.

9. Loudspeaker unit as claimed in claim 8, wherein the gap has a width between 0.3 mm and 3 mm.

10. Loudspeaker unit as claimed in claim 8, wherein the gap has a width of 1 mm.

11. Loudspeaker unit as claimed in claim 1, wherein the wedge-shaped body connects to the front wall of the loudspeaker housing and to the wall placed opposite the front wall.

12. Loudspeaker unit as claimed in claim 1, wherein the loudspeaker housing is provided with flat side walls, and wherein a gap is present between each of the side walls and the wedge-shaped body.

13. Loudspeaker unit as claimed in claim 12, wherein the gap has a width between 0.3 mm and 2 mm.

14. Loudspeaker unit as claimed in claim 13, wherein the gap has a width of 1 mm.

15. Loudspeaker unit as claimed in claim 1, wherein at least the wall placed opposite the front wall is provided with a damping material.

16. Loudspeaker unit as claimed in claim 15, wherein the damping material is wool.

17. Loudspeaker unit as claimed in claim 1, wherein a length of the loudspeaker unit in a direction transverse of a main plane of the wedge-shaped body is at least twice a width of the loudspeaker unit in a direction of an apex line of the wedge-shaped body.

18. Loudspeaker unit as claimed in claim 1, wherein the slopes of the sloping surfaces of the wedge-shaped body are adapted to take account of different frequency requirements in the first and second space in the loudspeaker housing.

* * * * *